United States Patent [19]

Miyazaki et al.

[11] Patent Number: 4,777,399

[45] Date of Patent: Oct. 11, 1988

[54] HIGH PRESSURE METAL VAPOR DISCHARGE LAMP

[75] Inventors: Kouichi Miyazaki; Akihiro Kamiya, both of Yokosuka; Akihiro Inoue, Chigasaka, all of Japan

[73] Assignee: Tokyo Shibaura Denki Kabushiki Kaisha, Kawasaki, Japan

[21] Appl. No.: 347,427

[22] Filed: Feb. 10, 1982

[30] Foreign Application Priority Data

Feb. 13, 1981 [JP] Japan ..... 56-19913

[51] Int. Cl.[4] ..... H01J 7/40; H01J 17/32; H01J 65/08

[52] U.S. Cl. ..... 313/54; 313/DIG. 7

[58] Field of Search ..... 313/54, DIG. 7

[56] References Cited

U.S. PATENT DOCUMENTS 3,275,873 9/1966 Houston ..... 313/54

3,928,781 12/1975 Edwards et al. ..... 313/54

*Primary Examiner*—William L. Sikes

*Assistant Examiner*—Robert E. Wise

*Attorney, Agent, or Firm*—Foley & Lardner, Schwartz, Jeffery, Schwaab, Mack, Blumenthal & Evans

[57] ABSTRACT

A high pressure metal vapor discharge lamp comprising a discharge tube with a pair of spaced main electrodes; a filling sealed in the discharge tube comprising a light emitting metal and a starting gas; a radioactive source comprising a radioactive substance entirely covered with an envelope of non-radioactive, heat- and corrosion-resistant material sealed inside the discharge tube, an outer tube enclosing the discharge tube, and circuit means for starting the discharge tube.

20 Claims, 1 Drawing Sheet

HIGH PRESSURE METAL VAPOR DISCHARGE LAMP

BACKGROUND OF THE INVENTION

The present invention relates to a high pressure metal vapor discharge lamp, and more particularly to an improved discharge lamp utilizing a radioactive substance in the discharge tube.

Generally, high pressure metal vapor discharge lamps, such as metal halide lamps and high pressure sodium vapor lamps, have high starting voltages although the luminous output and luminous efficiency thereof are high. Consequently, these lamps can only be started by applying sufficiently high voltages.

To reduce the starting voltage of such lamps, the inventors of the present invention have proposed the inclusion of a radioactive substance in the discharge tube of the lamps in their U.S. patent application Ser. No. 265,675. In this proposal, seeds or triggers for initial discharges are provided by electrons supplied from a radioactive substance having a short half-life ranging from 0.5 to $10^4$ years contained in the discharge tube of the lamp.

However, the radioactive substance having a short half-life is hazardous to humans, thus requiring extreme care and duplicate or triplicate security measures in its handling. Since various injuries are caused when the radioactive substance comes in contact with a human body, countermeasures must be taken to prevent the radioactive substance from being spattered in nearby areas.

Ordinarily, it is required that the radioactive substance be subjected to a smear test to establish that the substance may be safely handled without separating any trace of the substance. In the smear test, a radioactive source is contacted with a sheet of filter paper, and the paper sheet is then tested with a radioactive counter for the presence of any radioactivity. In other words, the smear test determines whether or not the radioactive substance tends to be displaced from the source to the filter paper.

U.S. patent application Ser. No. 273,112 discloses a countermeasure technique for preventing the spread of radioactive material which comprises dispersing or impregnating a radioactive substance in a ceramic material so that it will pass the smear test. However, the requirement for safety is limitless, and further improvement thereof is always desirable.

SUMMARY OF THE INVENTION

Therefore, it is an object of the present invention to provide a high pressure metal vapor discharge lamp with improved starting characteristics.

It is another object of the present invention to provide a high pressure metal vapor discharge lamp utilizing a short half-life radioactive substance to decrease the required starting voltage.

A further object of the present invention is to provide a high pressure metal vapor discharge lamp exhibiting a high degree of safety despite the presence of a short half-life radioactive substance.

Still another object of the present invention is to provide a high pressure metal vapor discharge lamp containing a radioactive substance which may be safely and easily handled during the manufacture of the lamp.

These and other objects have been achieved by providing a high pressure metal vapor discharge lamp comprising a discharge tube having a pair of spaced main electrodes, a filling sealed in the discharge tube comprising a light emitting metal and a starting gas, a radioactive source comprising a radioactive substance entirely covered with an envelope of non-radioactive, heat- and corrosion-resistant material sealed in the discharge tube, an outer tube enclosing the discharge tube, and electrical circuit means for starting the discharge tube.

BRIEF DESCRIPTION OF THE DRAWINGS

The invention will be described in further detail with reference to the accompanying drawings wherein like reference characters denote like parts in the various views.

DETAILED DESCRIPTION OF PREFERRED EMBODIMENTS

Figure 1:
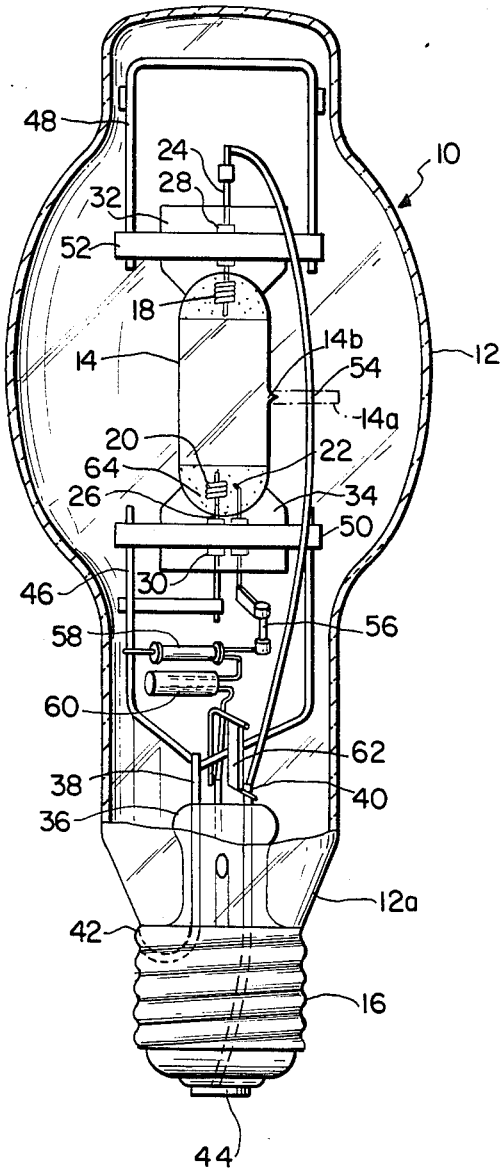
FIG. 1 is a longitudinal elevational view, partially in cross-section, of a high pressure metal vapor discharge lamp according to the present invention.

FIG. 1 depicts a metal-halide lamp 10 comprising a vitreous outer tube 12 and an inner tube or discharge tube 14 made of quartz glass or the like. Outer tube 12 is provided with a screw base 16 at one end thereof. Discharge tube 14 contains a filling comprising a quantity of mercury, which is substantially completely vaporized and exerts a pressure in operation, and a quantity of a metal halide such as sodium iodide (NaI) or scandium iodide (ScI). An inert rare gas, such as krypton, is included in the filling in the discharge tube 14 to facilitate starting and warm-up of the lamp. Opposed main electrodes 18 and 20 are mounted at opposite ends of discharge tube 14. An optional auxiliary starting electrode 22 may be provided near the main electrode 20. Electrodes 18 and 20 are supported on leads 24 and 26 which include thin metal foil sections 28 30 extending through respective pinch sealed ends 32, 34 of the discharge tube 14. Main electrodes 18 and 20 each comprise a rod around which a tungsten wire is wrapped in the form of a helix to increase the surface area of the electrode. The optional auxiliary starting electrode 22 may comprise a fine tungsten wire having only the tip thereof projecting into the discharge tube 14.

A neck part 12*a* of outer tube 12 is sealed by a stem 36 through which extend stiff lead wires 38 and 40 which are respectively connected at their outer ends to the screw shell 42 and to the eyelet contact 44 of the screw base 16.

Pinch sealed ends 32 and 34 of discharge tube 14 are attached to support structures 46 and 48 by metal holders 50 and 52 so that the discharge tube 14 is positioned centrally within outer tube 14. Support structure 46 is connected to lead wire 38.

Main electrode 20 is electrically connected to support structure 46, and main electrode 18 is electrically connected to a lead wire 40 via lead wire 54. Auxiliary starting electrode 22 is connected to the support structure 46 through a starting auxiliary resistor 56 and a current limiting resistor 58. Starting resistor 56 is also connected to lead wire 40 through resistor 58, a glow starter tube 60 and a bimetal switch 62. Switch 62 is adapted to close at normal temperature and to open above a predetermined temperature.

Figure 2:
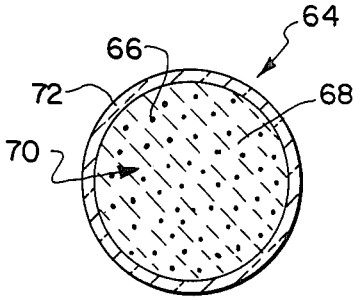
FIG. 2 is an enlarged cross-sectional view of a radioactive substance covered with an envelope of non-radioactive, heat- and corrosion-resistant material.

A radioactive source 64 is sealed inside discharge tube 14. Radioactive source 64 is constructed as shown in FIG. 2. A radioactive substance 66 is dispersed in or impregnated into a ceramic material 68, and the resulting ceramic body 70 is then enveloped or covered entirely by an envelope 72 of a non-radioactive, heat-resistant and corrosion-resistant material such as glass, ceramic, or metal. Radioactive source 64 is inserted through an exhaust tube 14*a* into discharge tube 14 before the discharge tube is sealed. Exhaust tube 14*a* is illustrated in phantom lines in FIG. 1. A projection or tip 14*b* which remains from the exhaust tube after the exhaust tube has been sealed off is shown in solid lines. The size of radioactive source 64 is chosen to be able to pass through the exhaust tube 14*a*.

The ceramic material 68 may comprise one or more substances selected from non-metal oxides such as silicon oxide ($SiO_2$); metal oxides such as aluminum oxide ($Al_2O_3$), sodium oxide ($Na_2O$), magnesium oxide (MgO), beryllium oxide (BeO), titanium monoxide (TiO) or dioxide ($TiO_2$), or calcium oxide (CaO); metal carbides such as aluminum carbide ($Al_4C_3$), sodium carbide ($Na_2C_2$), or calcium carbide ($CaC_2$), and metal nitrides such as aluminum nitride (AlN), sodium nitride ($Na_3N$), or magnesium nitride ($Mg_3N_2$).

The radioactive substance 66 dispersed in or impregnated into the ceramic material 68 preferably has a comparatively short half-life from about 0.5 to $10^4$ years. Desirably, the half-life may lie in the range from 0.5 to 10 years.

One or more radioactive substances from the group carbon ($^{14}C$), sodium ($^{22}Na$), calcium ($^{45}Ca$), manganese ($^{54}Mn$), iron ($^{55}Fe$), cobalt ($^{60}Co$), nickel ($^{63}Ni$), zinc ($^{65}Zn$), strontium ($^{90}Sr$), ruthenium ($^{106}Ru$), silver ($^{110}Ag$), antimony ($^{125}Sb$), barium ($^{133}Ba$), cesium ($^{134}Cs$), cerium ($^{144}Ce$), promethium ($^{147}Pm$), europium ($^{154}Eu$ $^{155}Eu$), gold ($^{195}Au$), thallium ($^{204}Tl$), lead ($^{210}Pb$), radium ($^{226}Ra$, $^{228}Ra$), actinium ($^{227}Ac$), thorium ($^{228}Th$), americium ($^{241}Am$), and curium ($^{242}Cm$, $^{244}Cm$), californium ($^{252}Cf$), and the like may be used as the radioactive substance 66.

High presure metal vapor lamps, such as metal-halide vapor lamps, generally have a useful life of about 10,000 hours. If a lamp is lighted for an average of about 5 hours a day, the normal operating life of the lamp can extend for up to six years. If a radioactive substance 66 has a half-life of 0.5 year, after six years the remaining activity of the substance will be $(\frac{1}{2})^{2\times 6}=(\frac{1}{2})^{12}\approx 2.4\times 10^{-4}$ times the initial activity at the beginning of the first year. This loss of radioactivity is sufficiently small that given a reasonable size initial charge of radioactive material, the remaining electron-releasing ability after six years should still be sufficient to start the lamp. However, if the half-life of the radioactive substance is less than 0.5 year, there is an increased likelihood that the electron-releasing ability of the substance may not be sufficient to last the expected life of the lamp.

If the half-life is too long, the rate of electron release is substantially reduced, and if insufficient electrons are released, it may be necessary to seal such a large quantity of radioactive substance in the discharge tube that chemical reactions may occur with other substances, such as halides, sealed in the tube which decreases the lumen output. It is desirable to maintain the total number of atoms of the radioactive substance at less than $10^{-3}$ times the total number of vaporized metal atoms sealed in the discharge tube to prevent decreased lumen output and blackening of the discharge tube. Accordingly, less than $10^{-6}$ g of a radioactive substance having a half-life of less than $10^4$ years is required to be sealed in the discharge tube to assure starting during the life of the lamp. This compares to 20 mg of thorium ($^{232}Th$) required in a lamp using thorium-232 as a radioactive source.

Moreover, in some countries such as Japan, a maximum of 100 microcuries (100 μCi) of radioactive substance are permitted to be used. It is therefore necessary to use less than 100 μCi per discharge tube. It is also necessary to release from 50 to 60 electrons, and desirably about 100 electrons, per second to maintain stable starting near the end of the lamp life, i.e., after about six years.

With regard to a 0.5 year half-life radioactive substance, it is necessary to have about $2.3\times 10^9$ atoms after six years, such that about $1\times 10^{13}$ atoms of total elementary number are required at the beginning of the lamp life. With regard to a $1\times 10^4$ year half-life radioactive substance, it is necessary to have about $4.5\times 10^{14}$ atoms at the beginning of the lamp life to assure sufficient electron release after six years. Accordingly, the number of required atoms of radioactive substance in this invention is less by a factor of from $10^5$ to $10^7$ times compared to a lamp using a thorium-232 in 20 mg thorium oxide, which includes $4.54\times 10^{19}$ atoms.

Radioactive source 62 may be prepared as follows:

First, an amount of aluminum oxide ($Al_2O_3$) is mixed with a predetermined amount of silicon oxide ($SiO_2$), and the resulting mixture is sintered into a ceramic material (zeolite). The ceramic material is then subjected to ion exchange by placing the ceramic in an ammonium chloride solution to replace $Na^+$ with $NH_4^+$. The treated ceramic material is then baked at 3000° C. to disociate the ammonium ions to $NH_3$ and $H^+$ and thereby to obtain hydrogen (H) type ceramic material. The ceramic material is then subjected to further ion exchange by placing the ceramic in a promethium chloride solution to replace hydrogen with promethium ($^{147}Pm$) When a predetermined amount of promethium ($^{147}Pm$) has been taken up, the ceramic material is baked at 1,300° C. for approximately one hour to remove H and Cl from the ceramic material.

The ceramic material is then placed in a silicon vapor evaporation device or vacuum deposition chamber for forming a $SiO_2$ layer or envelope 72 on the surface of the ceramic material. The thickness of the deposited $SiO_2$ layer may vary from 0.5 to 20 microns depending on the length of the vacuum deposition treatment.

Alternatively, the ceramic material after ion exchange with radioactive material such as promethium ($^{147}Pm$) may be placed in a tungsten vapor evaporating device (vacuum deposition chamber) for forming a tungsten layer or envelope 72 on the surface of the ceramic material. The thickness of the tungsten layer constituting envelope 72 may vary from 0.1 to about 60 microns or more.

When a voltage is applied through a ballast (not shown) to a metal halide lamp of the above-described construction, an electric current flows through the initially closed bimetal switch 62 through glow starter 60, and through current limiting resistor 58 so as to operate the glow starter tube 60. A bimetal contact in the glow starter tube 60 switches the current so that a pulse voltage is generated by a choke inductance in the ballast. The pulse voltage initiates an auxiliary discharge between main electrode 20 and auxiliary starting electrode 22. The auxiliary discharge develops to a main arc discharge between the main electrodes 18 and 20. After the initiation of the arc discharge, the metal halide contained in the discharge tube 14 evaporates, thus emitting light. As the metal halide evaporates, the voltage and temperature of the discharge tube 14 increase to such an extent that the bimetal switch 62 is opened. Thus, when the lamp is operated in its stable state, no current flows through the glow starter tube 60 thus closing the bimetal contact of the glow starter 60. Upon closure of the bimetal contact of the glow starter tube, the auxiliary starting electrode 22 and the main electrode 20 are held at the same potential, and the occurrence of recrystallization defects and cracks, which may occur in discharge tube 14 as a result of the application of a voltage between the two electodes 20 and 22, is prevented.

In a discharge lamp constructed as described above, a radioactive source 64 comprising a radioactive substance 66 is contained in the discharge tube 14. The radioactive substance emits ionizing radiation which provides free electrons to serve as seeds or triggers for the discharge. The presence of the seeds shortens the starting time and reduces the starting voltage of the discharge lamp. More specifically, the electrons emitted initially from the radioactive source 64 electrolytically dissociate the surrounding rare gas. An application of the pulse voltage when the dissociated rare gas is present, easily creates break-down in insulation within the discharge tube 14 for starting the discharge.

Conversely, when no radioactive source is contained in the discharge tube 14, no electrolytically dissociated gas is produced in the tube 14, and it is difficult to start the lamp. The discharge of the lamp is not started until a part of the rare gas is electrolytically dissociated by background radiation, e.g., cosmic rays or radiation from the earth or the like. Since the incidence of cosmic rays or earth radiation is extremely small, being on the order of once in 20 seconds or longer, the waiting time in starting of the discharge lamp becomes long.

As described above, the radioactive substance 66 of the invention is dispersed in a ceramic material 68, and there is almost no possibility of the radioactive substance separating from the ceramic material. Furthermore, since the radioactive substance-containing ceramic body 70 is completely covered by envelope 72, it can easily pass the smear test. Any danger of a slight amount of the radioactive substance adhering to a human body is thereby eliminated. Since the envelope 72 is comparatively thin, radiation, such as alpha rays, beta rays and gamma rays, emitted from the radioactive substance 66 can pass through the envelope 72 into the discharge tube 14. However, the radioactive substance itself is rigidly held in the ceramic body 70, and is prevented by the envelope 72 from being spattered even if the ceramic body falls to the floor or is otherwise subjected to a strong impact.

Suitable materials from which the envelope 72 may be made include a ceramic principally made of alumina ($Al_2O_3$) and/or silicon dioxide ($SiO_2$), a glass, or a metal such as aluminum, tungsten or the like. The same material used to form the electrodes may be used. The envelope material should be non-radioactive, capable of withstanding the high temperatures within the discharge tube 14, and non-reactive with or resistant to corrosion by the halides contained in the discharge tube 14.

As a result of the present invention in which a radioactive substance, contained in a light emitting tube of the lamp for improving the quick starting characteristics of the lamp, is dispersed in a ceramic material and the resulting ceramic material is entirely covered with a protective envelope, there is no likelihood that the radioactive substance will be spattered out of or scraped away from the ceramic material. Furthermore, the entire body can easily pass the smear test, and the handling safety of the radioactive substance is much improved.

The present invention is not limited to the described metal halide lamp but is also applicable to other high pressure discharge lamps such as sodium vapor lamps or mercury vapor lamps for improving the starting properties of the lamps.

The foregoing description has been set forth merely to illustrate the invention and is not intended to be limiting. Since modifications of the described embodiments incorporating the spirit and substance of the invention may occur to persons skilled in the art, the scope of the invention is to be limited solely with respect to the appended claims and equivalents.

We claim:

1. A high pressure metal vapor discharge lamp, comprising:

a discharge tube having a pair of spaced main electrodes;

a filling comprising a light emitting metal and a starting gas sealed in said discharge tube;

a radioactive source sealed inside said discharge tube, said source comprising a ceramic body impregnated with a radioactive substance and entirely covered with an envelope of non-radioactive, heat- and corrosion-resistant material sealed in said discharge tube;

an outer tube enclosing said discharge tube; and electrical circuit means for starting said discharge tube.

2. A high pressure metal vapor discharge lamp according to claim 1, wherein said radioactive substance has a half-life lying in the range from 0.5 year to $1\times10^4$ years.

3. A high pressure metal vapor discharge lamp according to claim 2, wherein said radioactive substance has a half-life lying in the range from 0.5 year to 10 years.

4. A high pressure metal vapor discharge lamp according to claim 1, wherein said ceramic material is formed from at least one material selected from the group consisting of non-metal oxides, metal oxides, metal carbides and metal nitrides.

5. A high pressure metal vapor discharge lamp according to claim 4, wherein said ceramic material is formed from silicon dioxide ($SiO_2$).

6. A high pressure metal vapor discharge lamp according to claim 4, wherein said ceramic material is formed from a metal oxide selected from the group consisting of aluminum oxide ($Al_2O_3$), sodium oxide ($Na_2O$), magnesium oxide ($MgO$), beryllium oxide ($BeO$), titanium monoxide ($TiO$), titanium dioxide ($TiO_2$), and calcium oxide ($CaO$).

7. A high pressure metal vapor discharge lamp according to claim 4, wherein said ceramic material is formed from a metal carbide selected from the group consisting of aluminim carbide ($Al_4C_3$), sodium carbide ($Na_2C_2$), and calcium carbide ($CaC_2$).

8. A high pressure metal vapor discharge lamp according to claim 4, wherein said ceramic material is formed from a metal nitride selected from the group consisting of aluminum nitride (AlN), sodium nitride ($Na_3N$), and magnesium nitride ($Mg_3N_2$).

9. A high pressure metal vapor discharge lamp according to claim 1, wherein said radioactive substance is selected from the group consisting of carbon ($^{14}C$), sodium ($^{22}Na$), calcium ($^{45}Ca$), manganese ($^{54}Mn$), iron ($^{55}Fe$), cobalt ($^{60}Co$), nickel ($^{63}Ni$), zinc ($^{65}Zn$), stronium ($^{90}Sr$), ruthenium ($^{106}Ru$), silver ($^{110}Ag$), antimony ($^{125}Sb$), barium ($^{133}Ba$), cesium ($^{134}Cs$, $^{137}Cs$), cerium ($^{144}Ce$), promethium ($^{147}Pm$), europium ($^{154}Eu$, $^{155}Eu$), gold ($^{195}Au$), thallium ($^{204}Tl$), lead ($^{210}Pb$), radium ($^{226}Ra$, $^{228}Ra$), actinium ($^{227}Ac$), thorium ($^{228}Th$), americium ($^{241}Am$), curium ($^{242}Cm$, $^{244}Cm$), and californium ($^{252}Cf$).

10. A high pressure metal vapor discharge lamp according to claim 1, wherein said envelope is formed of a glass.

11. A high pressure metal vapor discharge lamp according to claim 1, wherein said envelope is formed of a ceramic.

12. A high pressure metal vapor discharge lamp according to claim 1, wherein said envelope is formed of a metal.

13. A high pressure metal vapor discharge lamp according to claim 1, wherein said envelope is formed of metallic aluminum.

14. A high pressure metal vapor discharge lamp according to claim 1, wherein said envelope is formed of metallic tungsten.

15. A high pressure metal vapor discharge lamp according to claim 1, wherein said envelope comprises a vapor deposited layer of alumina.

16. A high pressure metal vapor discharge lamp according to claim 1, wherein said envelope comprises a vapor deposited layer of silicon dioxide.

17. A high pressure metal vapor discharge lamp according to claim 1, wherein said envelope comprises a vapor deposited metal layer.

18. A high pressure metal vapor discharge lamp according to claim 17, wherein said envelope comprises a vapor deposited tungsten layer.

19. A high pressure metal vapor discharge lamp according to claim 1, wherein a temporary exhaust tube is formed on said discharge tube and the diameter of said exhaust tube is larger than the diameter of said radioactive source, whereby said radioactive source may be introduced into said discharge tube through said exhaust tube.

20. A high pressure metal vapor discharge lamp according to claim 1, wherein said circuit comprises a glow starter tube for generating a high voltage pulse for initiating an electrical discharge in said discharge tube.

* * * * *